US007483662B2

(12) United States Patent
Shinkawa et al.

(10) Patent No.: US 7,483,662 B2
(45) Date of Patent: Jan. 27, 2009

(54) FIXING APPARATUS AND IMAGE FORMING APPARATUS EQUIPPED WITH THE SAME

(75) Inventors: Tatsuya Shinkawa, Nara (JP); Kimihide Tsukamoto, Osaka (JP); Takashi Yamanaka, Yamatokoriyama (JP); Kan Mukai, Yamatokoriyama (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 238 days.

(21) Appl. No.: 11/564,809

(22) Filed: Nov. 29, 2006

(65) Prior Publication Data

US 2007/0122212 A1 May 31, 2007

(30) Foreign Application Priority Data

Nov. 30, 2005 (JP) ..... 2005-347354

(51) Int. Cl.
*G03G 15/20* (2006.01)

(52) U.S. Cl. ..... 399/326; 399/327

(58) Field of Classification Search ..... 399/324–327
See application file for complete search history.

(56) References Cited

U.S. PATENT DOCUMENTS 5,978,640 A * 11/1999 Segawa ..... 399/327
2003/0210934 A1* 11/2003 Matsumoto ..... 399/324

FOREIGN PATENT DOCUMENTS

| | | |
|---|---|---|
| JP | 6-161316 | 6/1994 |
| JP | 9-101729 | 4/1997 |
| JP | 9-106210 | 4/1997 |
| JP | 2003-107952 | 4/2003 |

* cited by examiner

*Primary Examiner*—Hoang Ngo
(74) *Attorney, Agent, or Firm*—Renner, Otto, Boisselle & Sklar, LLP

(57) ABSTRACT

A fixing apparatus that firmly adheres unfixed toner onto a recording sheet includes a first cleaning unit for cleaning up toner adhering to a surface of a heating roller by using a belt-shaped cleaning member, and a second cleaning unit for cleaning up toner adhering to a surface of a pressurizing roller by using a roller-shaped member, wherein oil for promoting releasability is not supplied from the first cleaning unit whose cleaning member is an oilless member to the heating roller, and the oil is supplied only from the roller-shaped member of the second cleaning unit to the pressurizing roller.

6 Claims, 8 Drawing Sheets

FIXING APPARATUS AND IMAGE FORMING APPARATUS EQUIPPED WITH THE SAME

CROSS-REFERENCE TO RELATED APPLICATION

This application claims priority to Japanese Patent Application No. JP 2005-347354, which was filed on Nov. 30, 2005, the contents of which, are incorporated herein by reference, in their entirety.

BACKGROUND OF THE INVENTION

1. Field of the Invention

The present invention relates to a fixing apparatus favorably for use in an electrophotographic image forming apparatus, and to an image forming apparatus having the same.

2. Description of the Related Art

In an image formation using an electrophotographic manner, a photoreceptor charged to a uniform electric potential is exposed to light in accordance with image information so that an electrostatic latent image is formed. The formed electrostatic latent image is developed by a developer so as to be visualized. The visualized image is transferred on a recording paper or the like, and the transferred developer on the recording paper is made to be fixed so as to form a solid recording image.

The fixing apparatus used for such image formation, is generally composed of a heating roller and a pressure roller. The fixing apparatus has such a configuration that, in passing the recording paper on which the developer for forming a visualized image through a pressure-contact region (hereinafter referred to as a nip portion) of the heating roller and the pressure roller, which pressure-contact region is formed by pressing the pressure roller against the heating roller, unfixed developer is fused and fixed by heating of the heating roller and pressing of the pressure roller.

During a fixing operation in the fixing apparatus, there sometimes occurs a so-called hot offset that the developer fused on the nip portion of the both rollers is not all fixed on the recording paper, but a part of the developer is attached to a surface of the roller. For instance, the developer attached to the heating roller is transferred on a portion which should be properly a white base, on a recording paper on which the developer is to be subsequently fixed, with the result that an image defect is made to occur.

Moreover, on the pressure roller, the developer which has already fixed to a back surface of the conveyed recording paper, for instance as in a case of duplex print, is sometimes fused again by heat in passing through the nip portion and a part of the developer is transferred and attached to the pressure roller. The developer thus attached to the pressure roller may cause the image defect and further, may cause a soil of the back surface of the recording paper.

The image defect caused by the hot offset in the fixing apparatus sometimes remains, in a case of black-and-white print, mere defects such as a fog in a white base of the formed image, a soil on the back surface of the recording paper, or the like in a tolerable range. However, in a case of full-color print, since a developer having a color different from a prescribed one is transferred from the both rollers, there often occur practically intolerable defects.

In order to solve such problems, in a fixing apparatus, both a heating roller and a pressurizing roller, or only the heating roller is provided with a cleaning unit for cleaning a surface of the roller. FIG. 6 is a cross section view seen from the side, illustrating a simplified configuration of a conventional fixing apparatus 1.

The fixing apparatus 1 comprises a heating roller 2, a pressurizing roller 3, a temperature sensor 4 that detects a temperature of the heating roller 2, first and second paper peeling claws 5 and 6 that peel a recording medium such as a recording sheet winding around the heating roller 2 or the pressurizing roller 3 from the roller, and first and second cleaning rollers 7 and 8 that are the cleaning unit of the heating and pressurizing rollers 2 and 3.

The heating roller 2 has a heat source such as a heater 9 inside, and is heated and warmed by heat generated by the heater 9. A temperature at which the heating roller 2 heats is regulated by a control portion (not illustrated) that controls an operation of the heater 9 in accordance with a detection output of the temperature sensor 4. Toner of developer on a recording sheet is heated and melted by the warmed heating roller 2. The pressurizing roller 3 is placed so that a rotation axis thereof is parallel to a rotation axis of the heating roller 2 and so as to be pressed against the heating roller 2 and form a nip portion 10. The heating roller 2 and the pressurizing roller 3 are fixing rollers.

The first and second cleaning rollers 7 and 8 can rotate, and are disposed so as to be in contact with and slide on the heating and pressurizing rollers 2 and 3 (these rollers may be generically referred to as the fixing rollers), respectively. The first and second cleaning rollers 7 and 8 may rotate in a forward direction with respect to rotation directions of the heating and pressurizing rollers 2 and 3, or may rotate in a backward direction.

Here, the forward direction does not relate to a rotation direction around the axis but means a rotation direction such that surfaces of both the contacting rollers move in the same directions in an abutting area. The backward direction means a rotation direction such that the surfaces of both the contacting rollers move in the opposite directions, that is, pass each other in the abutting area.

The first and second cleaning rollers 7 and 8 slidingly rub the heating and pressurizing rollers 2 and 3 rotating with the cleaning members, thereby eliminating toner adhering to the surfaces of the fixing rollers and cleaning up the fixing rollers. However, toner that has been eliminated from the heating and pressurizing rollers 2 and 3 and has adhered and accumulated onto the first and second cleaning rollers 7 and 8 adheres to the heating and pressurizing rollers 2 and 3 again from the first and second cleaning rollers 7 and 8 while the first and second cleaning rollers 7 and 8 keep rotating and continue a cleaning operation, with the result that it becomes impossible to obtain a cleaning effect. The fixing apparatus 1 has a problem such that in order to obtain a good cleaning effect at all times, the first and second cleaning rollers 7 and 8 must be replaced with unused ones with extremely high frequency.

The fixing apparatus 1 as described above is appropriate to be installed in a so-called low-speed machine in which the number of recording sheets subjected to image formation per unit time is small. In a case where the fixing apparatus 1 is installed in the low-speed machine, an influence of heat extraction by recording sheets is small and a surface temperature of the heating roller 2 is kept at a set temperature that is appropriate for fixing, because an image formation processing speed is low and an interval of fed printing sheets is long. Accordingly, the residual toner adhering to the fixing rollers, especially, the heating roller 2 is securely brought into a molten state on the surface of the heating roller 2, with the result that the toner is fully cleaned up by the cleaning roller 7, and it is prevented that a recording sheet is stained.

These days, however, increase of an image formation processing speed in an image forming apparatus is required as increase of office work efficiency is required, and a so-called high-speed machine in which an image formation processing speed is as high as it can process 100-120 sheets per minute is in practical use. In the high-speed machine in which the number of sheets subjected to an image formation process per unit time is large, it is difficult to keep the surface temperature of the heating roller at the set temperature appropriate for fixing, because a large number of recording sheets pass by the surface of the heating roller warmed by set consumption of electric power and a large amount of heat is extracted. Therefore, the fixing apparatus 1 using the cleaning rollers has a problem such that in a case where the fixing apparatus is installed in the high-speed machine, it is impossible to obtain a sufficient cleaning effect.

In a prior art for solving such problems, a belt-shaped cleaning member called a web sheet is used, whereby continuous supply of the cleaning member is enabled to seek the maintaining of cleaning performance, and a length of the cleaning member abutting on the fixing roller in the rotation direction of the roller is increased to seek increase of the cleaning effect (refer to Japanese Unexamined Patent Publication JP-A 2003-107952).

FIG. 7 is a cross section view seen from the side, illustrating a simplified configuration of a conventional fixing apparatus 11 using the belt-shaped cleaning member. The fixing apparatus 11 is similar in basic configuration to the fixing apparatus 1 illustrated in FIG. 6, but is configured so as to be capable of matching the high-speed machine. That is to say, in order to deal with heat extraction by recording sheets and keep the fixing rollers at the set temperature, a heating roller 12 is provided with two heaters 20*a* and 20*b*, and a pressurizing roller 13 is provided with a heater 21. Accordingly, as the temperature sensors, a first temperature sensor 14 that detects a temperature of the heating roller 12 and a second temperature sensor 15 that detects a temperature of the pressurizing roller 13 are disposed. Moreover, the first cleaning unit 18 that has the belt-shaped cleaning member is provided for the heating roller 12 between a first paper peeling claw 16 and the first temperature sensor 14 with respect to a rotation direction of the heating roller 12, and the second cleaning unit 19 that has the belt-shaped cleaning member is provided for the pressurizing roller 13 between a second paper peeling claw 17 and the second temperature sensor 15 with respect to a rotation direction of the pressurizing roller 13.

Since the first and the second cleaning unit 18 and 19 are configured so as to be symmetrical with respect to a recording sheet 23 passing through a nip portion 22 that is a pressure-contact area of the heating roller 12 and the pressurizing roller 13, a configuration of the first cleaning unit 18 will be described as a representative.

The first cleaning unit 18 includes a wound belt-shaped cleaning member 24 called a web sheet, a feed-out roller 25 that sends out the cleaning member 24, a take-up roller 26 that winds up the cleaning member 24 fed out from the feed-out roller 25, and a pressure-contact roller (may be referred to as the web pressure-contact roller) 27 disposed between the feed-out roller 25 and the take-up roller 26 so as to press the cleaning member 24 against the heating roller 12. Although driving means for driving the feed-out roller 25 and the take-up roller 26 is also included in the first cleaning unit 18, illustration thereof is omitted here.

The cleaning unit 18 and 19 press the cleaning members 24 against the heating and pressurizing rollers 12 and 13 (the fixing rollers) rotationally driven in directions of arrows 28 and 29, respectively, in a state where the take-up rollers 26, the feed-out rollers 25 and the pressure-contact rollers 27 are not rotated and are kept still, and make the fixing rollers and the cleaning members 24 slidingly rub each other, thereby eliminating molten toner adhering to circumferential faces of the fixing rollers, and storing the eliminated toner in an almost molten state into gaps formed by the cleaning members 24 located between the pressure-contact rollers 27 and the take-up rollers 26 and the surfaces of the fixing rollers.

When the toner stored in the gaps reaches a certain amount, the cleaning unit 18 and 19 cause the take-up rollers 26 to perform a take-up operation in a direction of arrow 30 to take up the cleaning members 24 by a predetermined length, and make the toner leave from the surfaces of the fixing rollers in a state where the toner remains adhering to the cleaning members 24.

According to the cleaning unit 18 and 19 using the cleaning members 24, it is possible to feed out unused parts of the cleaning members 24 from the feed-out rollers 25 and recover cleaning ability, at a point of time that the cleaning members 24 have cleaned up a certain amount of toner. Therefore, it is possible to avoid complicatedness of frequent replacement of the cleaning members. Moreover, it is possible to increase the length of the cleaning member 24 abutting on the fixing roller in the rotation direction of the fixing roller, by pressing the cleaning member 24 by the pressure-contact roller 27, with the result that it is possible to obtain a good cleaning effect in the high-speed machine in which fixing on a recording sheet is executed with high frequency.

However, both the fixing apparatus 1 and the fixing apparatus 11 using the belt-shaped cleaning member 24 have a problem as follows. In general, oil is applied to the fixing rollers of the fixing apparatuses 1 and 11 in order to promote releasability of a recording sheet on which a toner image has been fixed from the rollers.

In a case where the cleaning rollers as in the fixing apparatus 1 are used, the oil is applied by a method such as pump up the oil from, for example, an oil tank to supply to the surfaces of the cleaning rollers and apply the oil to the surfaces of the fixing rollers from the surfaces of the cleaning rollers (for example, refer to Japanese Unexamined Patent Publication JP-A 9-106210 (1997)). Moreover, in a case where the belt-shaped cleaning members as in the fixing apparatus 11 are used, the oil is applied by a method such as impregnate the oil into the cleaning members in advance and press the cleaning members against the fixing rollers by the pressure-contact rollers, thereby applying the oil to the surfaces of the fixing rollers (for example, refer to Japanese Unexamined Patent Publication JP-A 9-101729 (1997)).

The oil applied to the surfaces of the fixing rollers is heated and softened by the warmed fixing rollers, thereby existing as thin films on the surfaces of the fixing rollers, and promoting releasability of a recording sheet on which a toner image has been fixed from the rollers. However, no matter which of the oil application methods described above is adopted, an "excessive oil phenomenon" that the oil applied to the surfaces of the fixing rollers becomes slightly excessive often occurs. For example, in a case where the cleaning members impregnated with the oil in advance are used, in an initial state where unused parts are fed out from the feed-out rollers and used for cleaning, the amount of the oil seeping out of the cleaning members when the cleaning members are pressed against the fixing rollers by the pressure-contact rollers is large, and becomes slightly excessive.

A state where the oil on the fixing rollers is excessive will be described below, taking the fixing apparatus 11 as an example. FIG. 8 is a view for describing a state where a mixture of the toner and the oil accumulates in the vicinity of tip portions of the paper peeling claws 16 and 17 in the fixing apparatus 11.

When the oil on the fixing rollers becomes excessive, and the toner heated and melted by the fixing rollers, especially, the heating roller 12 mix the oil, whereby slipperiness of the mixture becomes extremely high. Accordingly, even if the mixture of the residual toner on the heating roller 12 and the oil rotationally moves together with the heating roller 12 while adhering to the heating roller 12 and enters the pressure-contact area of the heating roller 12 and the cleaning member 24, the oil contained in the mixture and the oil impregnated into the cleaning member 24 cause slipping, and the mixture slips through, with the result that a phenomenon such that the mixture cannot be eliminated by the cleaning member 24 and cleaning performance decreases occurs.

The mixture having slipped through the pressure-contact area of the cleaning member 24 and the heating roller 12 rotationally moves more together with the heating roller 12, and part of the mixture shifts to the pressurizing roller 13 in the pressure-contact area (the pressure-contact area when a recording sheet does not exist) of the heating roller 12 and the pressurizing roller 13. The mixtures of the toner and the oil adhering to the heating roller 12 and the pressurizing roller 13, respectively, rotationally move in accordance with rotation of the heating and pressurizing rollers 12 and 13, and the mixtures are scraped by tip portions 16*a* and 17*a* abutting on the rollers of the first and second paper peeling claws 16 and 17 disposed to the heating roller 12 and the pressurizing roller 13, respectively, and accumulate as mixture lumps 31 and 32 in the vicinity of the tip portions 16*a* and 17*a*.

After the recording sheet 23 on which a toner image has been formed in an image forming portion of an image forming apparatus is sent to the fixing apparatus 11 and passed through the nip portion 22 to be subjected to fixing, the recording sheet is ejected from the nip portion 22 in a direction, for example, along the circumferential face of the heating roller 12, and peeled from the heating roller 12 by the first paper peeling claw 16. The recording sheet 23 peeled from the heating roller 12 is further conveyed along the first paper peeling claw 16, but when the recording sheet ejected from the nip portion 22 of the fixing rollers reaches a certain length, a part around a tip portion 23*a* of the recording sheet 23 in a conveying direction falls downward in the vertical direction (a direction of arrow 33) due to a weight of the recording sheet 23 itself.

At this moment, a part of the recording sheet 23 located in the vicinity of the tip portion 16*a* of the first paper peeling claw 16 moves toward the tip portion 16*a* of the first paper peeling claw 16 in reaction when the tip portion 23*a* of the recording sheet 23 falls downward, and comes in contact with the mixture lump 31 accumulated in the vicinity of the tip portion 16*a* of the first paper peeling claw 16, with the result that a stain like a small dot or like a comet leaving a long thin trail is formed on the surface of the recording sheet 23. Such a stain is formed also in a case where the recording sheet 23 is ejected along the pressurizing roller 13.

Thus, the conventional fixing apparatuses have a problem such that when the oil supplied in order to promote releasability of a recording sheet on which a toner image has been formed from the fixing roller is excessively supplied, the mixture of the molten toner and the oil accumulates on the fixing roller, especially, in the vicinity of the tip portion of the paper peeling claw and makes a stain on the recording sheet.

SUMMARY OF THE INVENTION

An object of the invention is to provide a fixing apparatus that is capable of making the amount of oil supplied to fixing rollers appropriate and preventing that a stain caused by a mixture of molten toner and the oil is made, thereby forming a fixed image of excellent image quality, and also provide an image forming apparatus equipped with the fixing apparatus.

The invention provides a fixing apparatus comprising:

a heating roller and pressurizing roller that form a couple of rotation bodies, the heating roller and pressurizing roller melt and fix unfixed developer on a recording medium on which an image of the unfixed image is formed by passing the recording medium through a pressure-contact area formed by the heating roller and pressurizing roller;

a first cleaning unit disposed so as to abut on a surface of the heating roller, for cleaning up developer adhering to the surface of the heating roller; and a second cleaning unit disposed so as to abut on a surface of the pressurizing roller, for cleaning up developer adhering to the surface of the pressurizing roller and also supplying oil for promoting releasability of the surface of the pressurizing roller, wherein the first cleaning unit has a belt-shaped cleaning member disposed so as to abut on the surface of the heating roller, for cleaning the surface of the heating roller;

a pressure-contact roller disposed so as to press the cleaning member against the heating roller on which the cleaning member abuts;

a feed-out roller for feeding out the cleaning member; and a take-up roller for taking up the cleaning member having been fed out from the feed-out roller and having cleaned the surface of the heating roller.

According to the invention, the fixing apparatus is provided with the first cleaning unit disposed so as to abut on the surface of the heating roller, for cleaning up the developer adhering to the surface of the heating roller, and the second cleaning unit disposed so as to abut on the surface of the pressurizing roller, for cleaning up the developer adhering to the surface of the pressurizing roller and also supplying the oil for promoting releasability to the surface of the pressurizing roller. The first cleaning unit provided for the heating roller does not supply the oil to the heating roller, the second cleaning unit provided for the pressurizing roller supplies the oil to the pressurizing roller, and the oil restrictively supplied from the pressurizing roller that is one of the fixing rollers is shared by both the rollers, whereby it becomes possible to supply only a proper amount of oil for maintaining releasability of a recording sheet. Therefore, it is possible to prevent occurrence of the excessive oil phenomenon that the oil becomes excessive on the fixing rollers. Consequently, formation of a mixture of the excessive oil and molten toner is also prevented, and the molten toner remaining on the fixing rollers is securely eliminated and the fixing rollers are cleaned up by the first and second cleaning unit, and formation of a mixture lump of the oil and the molten toner is prevented. As a result, it is possible to prevent that a stain is made on a recording sheet on which an image has been fixed.

Further, the first cleaning unit is configured so as to have the wound belt-shaped cleaning member for cleaning the surface of the heating roller, the pressure-contact roller for pressing the cleaning member against the heating roller, the feed-out roller for feeding out the belt-shaped cleaning member, and the take-up roller for taking up the cleaning member having been fed out from the feed-out roller and having cleaned the surface of the heating roller. According to such cleaning unit, it is possible to increase a length of the cleaning member in a rotation direction of the roller in a pressure-contact area against the fixing roller, whereby it is possible to increase cleaning efficiency. Moreover, since it is possible to feed out an unused part of the cleaning member and recover cleaning ability of the cleaning member when the cleaning ability decreases, it is possible to reduce the frequency of replacement of components necessary for cleaning.

Further, in the invention, it is preferable that the belt-shaped cleaning member of the first cleaning unit is an oilless member that is not impregnated with the oil.

According to the invention, the belt-shaped cleaning member of the first cleaning unit is an oilless member that is not impregnated with the oil. Consequently, the oil is not directly supplied to the heating roller, and the heating roller and the pressurizing roller share the oil supplied on the side of the pressurizing roller, with the result that it is possible to securely prevent that the oil supplied to the fixing rollers becomes excessive.

Furthermore, in the invention, it is preferable that the second cleaning unit includes:

a core body member that has a cylindrical shape and is provided with a plurality of through holes piercing a wall of the cylinder;

an exterior member made of a fibrous material and disposed in layers on a circumferential face of the core body member; and the oil for promoting releasability, which is held in a space within the cylinder of the core body member.

According to the invention, the second cleaning unit includes: the core body member that has a cylindrical shape and is provided with the plurality of through holes piercing the wall of the cylinder; the exterior member made of a fibrous material and disposed in layers on the circumferential face of the core body member; and the oil for promoting releasability, which is held in the space within the cylinder of the core body member. The second cleaning unit thus configured is capable of making the oil well up on the exterior member from the through holes of the core body member and then making the oil penetrate through the exterior member, thereby supplying the oil to the surface of the pressurizing roller. Therefore, by regulating the diameters of the through holes formed on the core body member, the number of the through holes, fiber density of the exterior member and so on, it is possible to make the amount of the oil supplied to the pressurizing roller proper, and it is possible to securely prevent that the amount of the oil supplied to the fixing rollers becomes excessive.

Still further, in the invention, it is preferable that the fixing apparatus further comprises:

a first paper peeling claw for peeling a recording medium having passed through the pressure-contact area of the heating roller and the pressurizing roller from the heating roller; and a temperature sensor for detecting a temperature of the heating roller, wherein the first cleaning unit is placed between the first paper peeling claw and the temperature sensor with respect to a rotation direction of the heating roller.

According to the invention, the fixing apparatus further comprises the first paper peeling claw for peeling a recording medium from the heating roller and the temperature sensor for detecting the temperature of the heating roller, and the first cleaning unit is placed between the first paper peeling claw and the temperature sensor with respect to the rotation direction of the heating roller. Therefore, a region of the heating roller having cleaned by the first cleaning unit rotationally moves more and reaches the temperature sensor placed on a downstream side in the rotation direction, so that the heating roller can come in contact with the temperature sensor in a clean condition. Consequently, it is avoided that toner adheres to the temperature sensor from the heating roller, and it is possible to prevent the temperature sensor from being stained, with the result that it is possible to seek increase of the accuracy of temperature detection by the temperature sensor.

Still further, it is preferable that the fixing apparatus further comprises a second paper peeling claw for peeling a recording medium having passed through the pressure-contact area of the heating roller and the pressurizing roller from the pressurizing roller, wherein the second cleaning unit is placed on a downstream side of the second paper peeling claw with respect to a rotation direction of the pressurizing roller.

According to the invention, the fixing apparatus further comprises the second paper peeling claw for peeling a recording medium from the pressurizing roller, and the second cleaning unit is placed on the downstream side of the second paper peeling claw with respect to the rotation direction of the pressurizing roller. Consequently, it is avoided that the oil supplied by the second cleaning unit stays at the second paper peeling claw, so that adhesion of the oil to a tip portion of a conveyed and peeled recording sheet is dispelled, and printed paper that is a recording sheet having been subjected to image formation and fixing looks better.

Still further, the invention provides an image forming apparatus for forming a printed image by electrophotography, comprising one of the fixing apparatuses described above.

According to the invention, the image forming apparatus is equipped with one of the fixing apparatuses described above, and therefore, is capable of stably forming high-quality images without stains for many hours.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
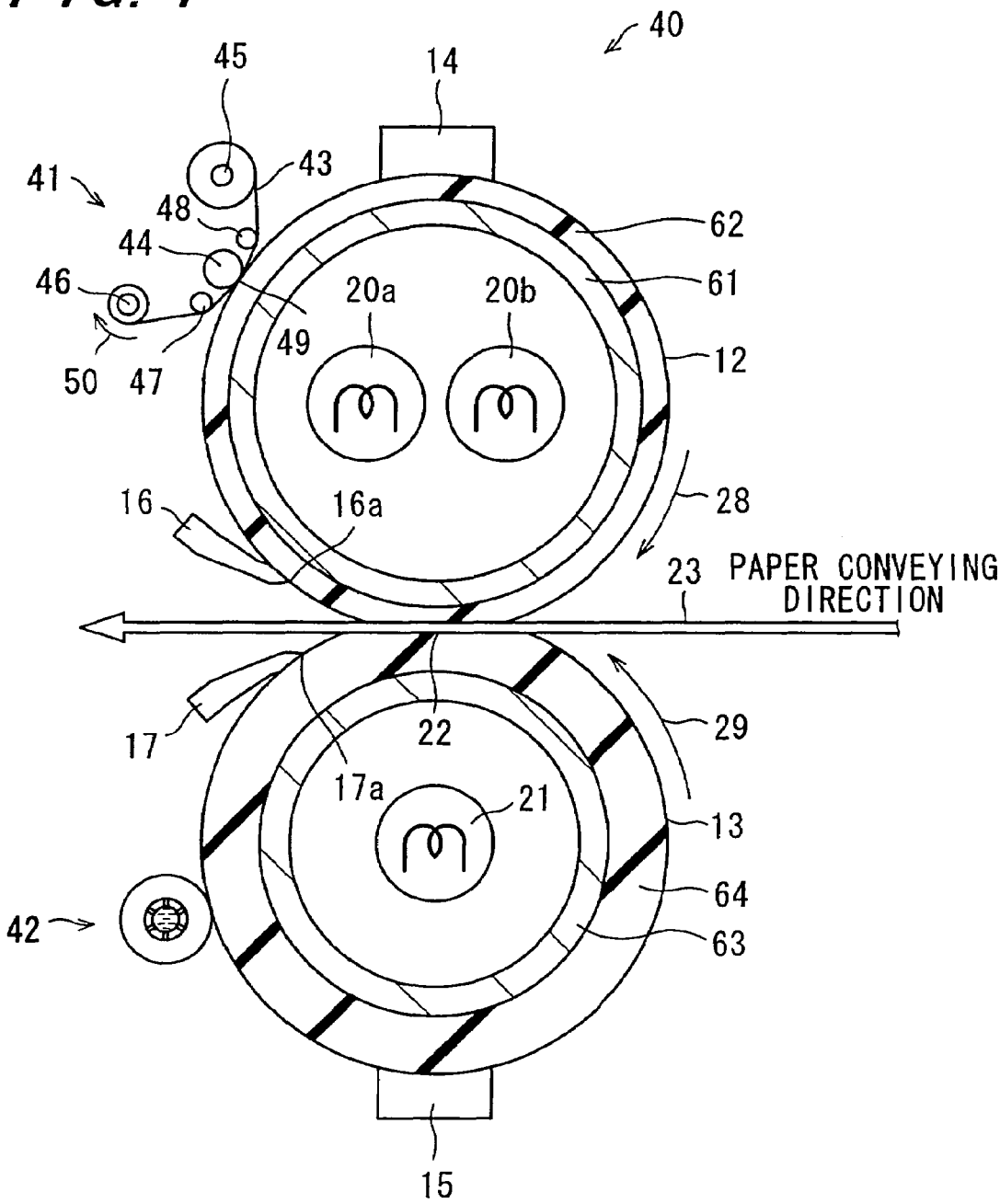
FIG. 1 is a cross section view seen from the side, illustrating a simplified configuration of a fixing apparatus according to an embodiment of the invention.

Now referring to the drawings, preferred embodiments of the invention are described below.

Figure 7:
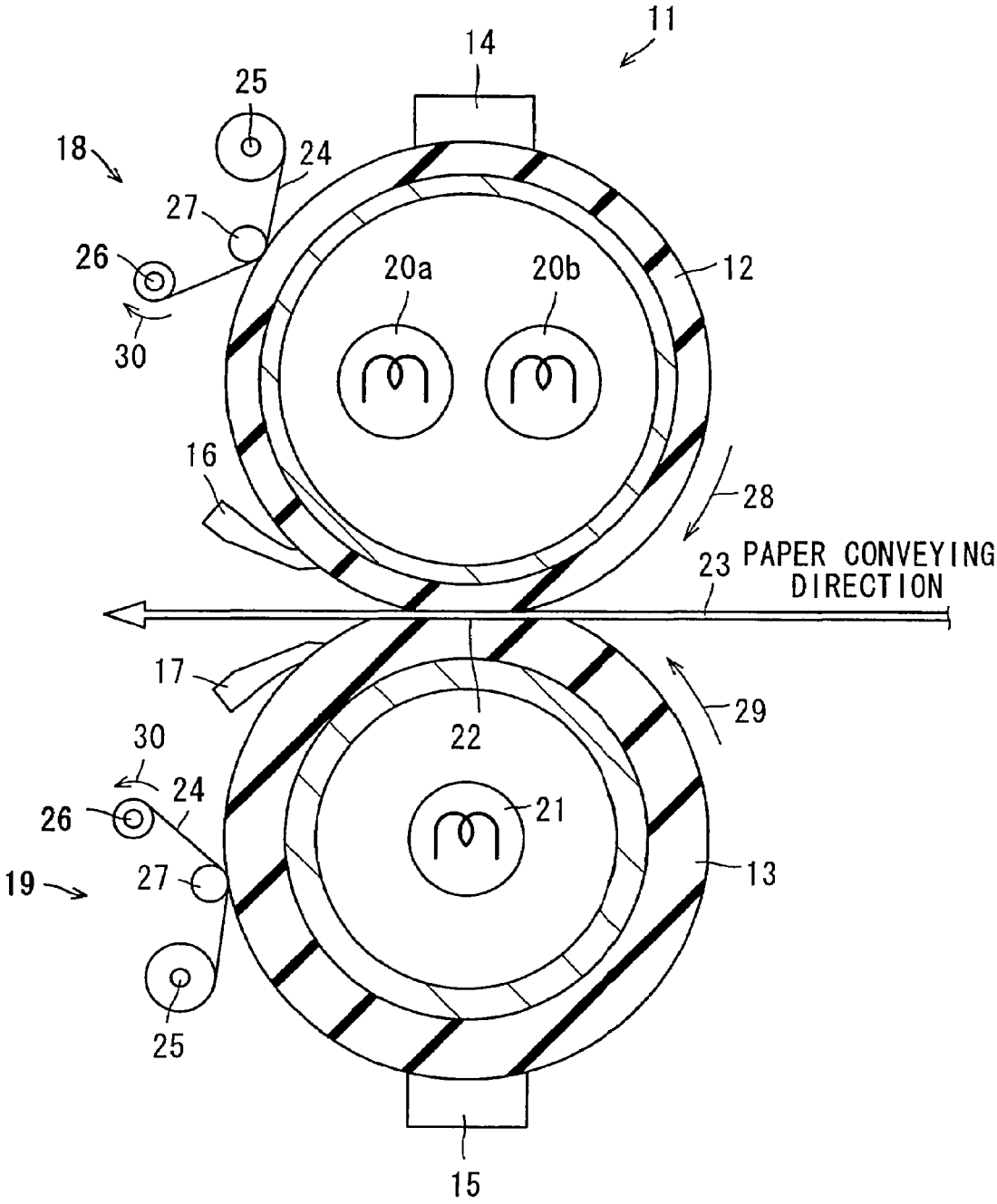
FIG. 7 PRIOR ART
FIG. 7 is cross section view seen from the side, illustrating a simplified configuration of a conventional fixing apparatus using a belt-shaped cleaning member.
Figure 8:
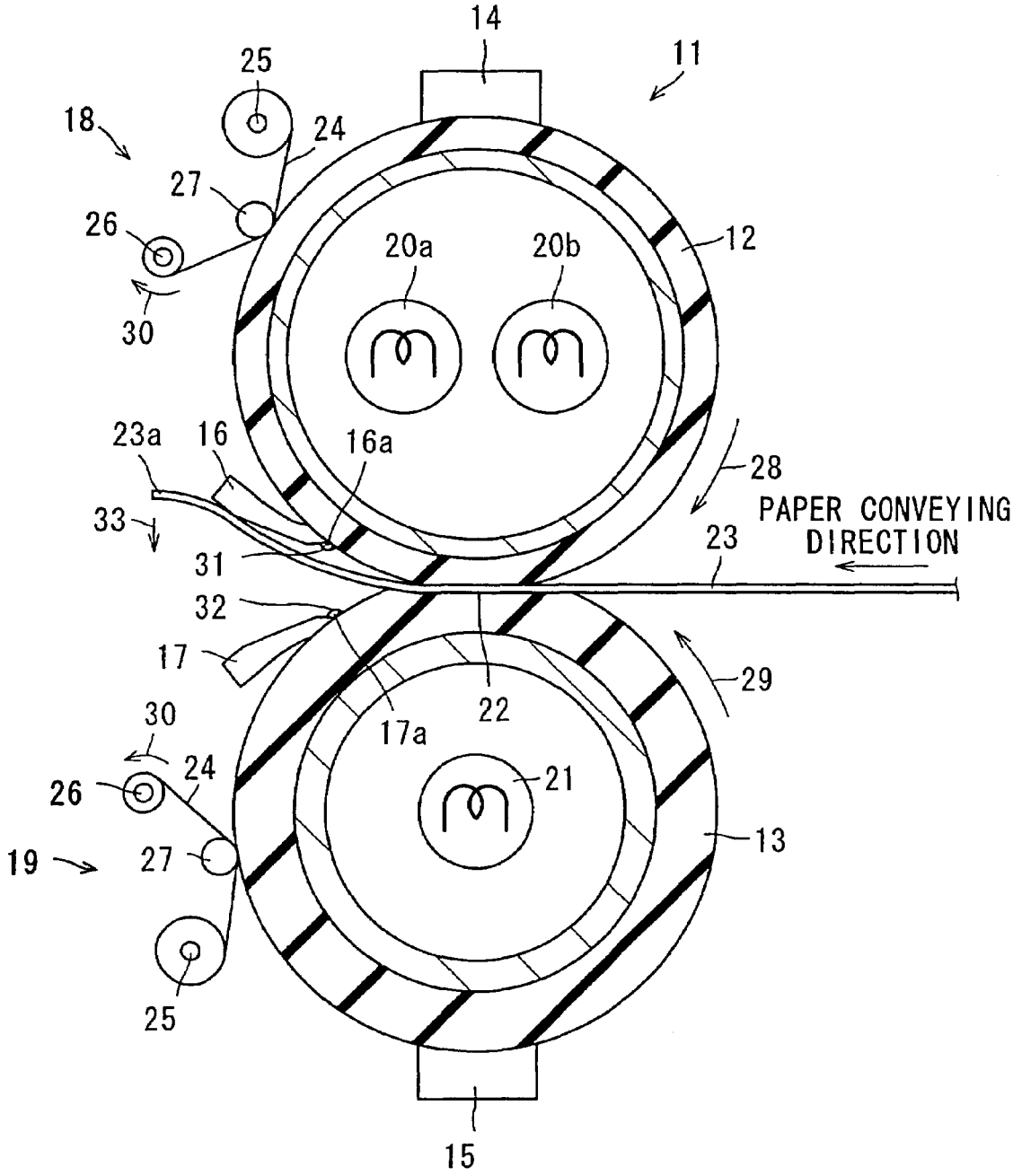
FIG. 8 PRIOR ART
FIG. 8 is a view illustrating a state where a mixture of toner and oil accumulates in the vicinity of a tip portion of a paper peeling claw in the fixing apparatus.

FIG. 1 is a cross section view seen from the side, illustrating a simplified configuration of a fixing apparatus 40 according to an embodiment of the invention. Since the fixing apparatus 40 of the present embodiment has a configuration similar to that of the fixing apparatus 11 illustrated in FIG. 7 described before, corresponding portions will be denoted by the same reference numerals, and descriptions thereof may be simplified or omitted.

The fixing apparatus 40 of the invention is characterized by comprising a first cleaning unit 41 disposed so as to abut on the surface of the heating roller 12, for cleaning up developer adhering to the surface of the heating roller 12, and a second cleaning unit 42 disposed so as to abut on the surface of the pressurizing roller 13, for cleaning up developer adhering to the surface of the pressurizing roller 13 and also supplying oil for promoting releasability to the surface of the pressurizing roller 13.

Further, the fixing apparatus 40 is provided with portions, which are not illustrated in the drawing, the same as those provided in a well-known fixing apparatus, such as a heater control power source that supplies electric power to the heaters 20*a* and 20*b* serving as heat sources provided in the heating roller 12 and the heater 21 serving as a heat source provided in the pressurizing roller 13, a pressing portion for pressing the pressurizing roller 13 against the heating roller 12, and a driving portions for rotationally driving the heating roller 12 and the pressurizing roller 13.

The fixing apparatus 40 is installed in an electrophotographic image forming apparatus or the like, and used for passing a recording medium such as a recording sheet 23 on which an image of unfixed developer has been formed through the nip portion 22 that is a pressure-contact area formed by the heating roller 12 and the pressurizing roller 13 that are a pair of rotation bodies, and melting and firmly adhering the unfixed developer onto the recording sheet 23.

The heating roller 12 includes a core metal portion 61 having a cylindrical shape, an elastic top layer portion 62 disposed on a circumferential face of the core metal portion 61, and the heaters 20*a* and 20*b* disposed inside the core metal portion 61. The core metal portion 61 is made of metal such as aluminum alloy or stainless steel, and the elastic top layer portion 62 is made of an elastic body having heat resistance, for example, silicone rubber. The heating roller 12 is warmed by the heaters 20*a* and 20*b* disposed inside, a temperature thereof is detected by the first temperature sensor 14, the detected temperature is inputted to the heater control power source that supplies electric power to the heaters 20*a* and 20*b*, and a surface temperature of the heating roller 12 is controlled by the heater control power source so as to become a set temperature for fixing.

The pressurizing roller 13 is disposed so that an axial line thereof is parallel to an axial line of the heating roller 12 and so as to be pressed against the heating roller 12 by the pressing portions and form the nip portion 22. The pressurizing roller 13 is similar to the heating roller 12, and includes a core metal portion 63 having a cylindrical shape, an elastic top layer portion 64 disposed on a circumferential face of the core metal portion 63, and the heater 21 disposed inside the core metal portion 63. The core metal portion 63 and the elastic top layer portion 64 are made of the same materials as those of the heating roller 12, respectively. The pressurizing roller 13 in the present embodiment has the heater 21 inside in the same manner as the heating roller 12. In a case where the fixing apparatus is installed in an image forming apparatus in which a printing process speed is high as described before, the amount of heat extracted from the fixing rollers is large. Therefore, the pressurizing roller 13 is also provided with the heater 21 in order to return the temperature to the set temperature early when heat is extracted and the temperature is reduced.

The first and second paper peeling claws 16 and 17 are members each of which is substantially wedge-shaped in cross section, and are disposed so that the wedge-shaped tip portions 16*a* and 17*a* abut on the heating roller 12 and the pressurizing roller 13, respectively. The first and second paper peeling claws 16 and 17 are placed near the nip portion 22 formed by the heating roller 12 and the pressurizing roller 13, on downstream sides of the nip portion 22 with respect to the rotation directions of the heating roller 12 and the pressurizing roller 13, respectively, and operate so as to peel recording sheets having been subjected to a fixing process and wound around the fixing rollers. In a positional relationship centered on the nip portion 22, the first paper peeling claw 16 is placed on an upstream side of the first temperature sensor 14 with respect to the rotation direction of the heating roller 12 (the direction of arrow 28), and the second paper peeling claw 17 is placed on an upstream side of the second temperature sensor 15 with respect to the rotation direction of the pressurizing roller 13 (the direction of arrow 29).

The first temperature sensor 14 that detects the surface temperature of the heating roller 12 and the second temperature sensor 15 that detects the surface temperature of the pressurizing roller 13 are either contact-type thermometers or noncontact-type thermometers, and it is possible to use well-known thermometers.

The first cleaning unit 41 is placed between the first paper peeling claw 16 and the first temperature sensor 14 with respect to the rotation direction of the heating roller 12.

The first cleaning unit 41 is configured so as to have a cleaning member 43, a pressure-contact roller 44, a feed-out roller 45, a take-up roller 46, a first guide roller 47, and a second guide roller 48. The cleaning member 43 is the belt-shaped cleaning member that is wound like a coil or a roll and disposed so as to abut on the surface of the heating roller 12, for cleaning the surface of the heating roller 12. The pressure-contact roller 44 is disposed so as to press the cleaning member 43 against the heating roller 12 on which the cleaning member 43 abuts. The feed-out roller 45 feeds out the belt-shaped cleaning member 43. The take-up roller 46 takes up the cleaning member 43 having been fed out from the feed-out roller 45 and having cleaned the surface of the heating roller 12. The first guide roller 47 is disposed so as to abut on the cleaning member 43 between the pressure-contact roller 44 and the take-up roller 46. The second guide roller 48 is disposed so as to abut on the cleaning member 43 between the feed-out roller 45 and the pressure-contact roller 44.

The first cleaning unit 41 includes a pressure-contact roller pressing portion for pressing the pressure-contact roller 44 against the heating roller 12, a guide roller pressing portion for pressing the first and second guide rollers 47 and 48 against the cleaning member 43, and a driving portion for driving the take-up roller 46 and the feed-out roller 45, but illustration thereof is omitted.

The cleaning member 43 (also referred to as a web sheet) is disposed so as to abut on the heating roller 12, and cleans the surface of the heating roller 12. The cleaning member 43 is a belt-shaped long member that can be wound up and wound back. The cleaning member used here is a member that has a structure capable of impregnating (absorbing) toner of developer adhering to the surface of the heating roller 12 in a molten state into a minute space like an air layer and/or an air gap, and that has heat resistance at a temperature of about 200° C. of a fixing temperature.

As the cleaning member 43, it is preferable to use Nomex Paper (product name) though it is possible to use western paper made of pulp, Japanese paper made of a material such as paper mulberry or oriental paper bush and so on. No matter which of paper and Nomex Paper is used, the invention is characterized in that an oilless member that is not impregnated with oil at all is used as the cleaning member 43.

The pressure-contact roller 44 is formed so that at least an outermost layer is made of a heat-resistant elastic material, so as to deform to a certain extent when being pressed against the heating roller 12 and form a pressure-contact region 49 (this pressure-contact region will be referred to as the nip portion 49 hereafter) with the heating roller 12. The pressure-contact roller 44 is disposed so that an axial line thereof is parallel to an axial line of the heating roller 12 and so as to press the cleaning member 43 interposed between the heating roller 12 and the pressure-contact roller against the surface of the heating roller 12 by the aforementioned pressing means.

The feed-out roller 45 is a reel-like member, a round which a predetermined length of cleaning member 43 is wound. The feed-out roller 45 is connected to a feed-out roller driving portion (not illustrated), and configured so as to be reversibly rotated, that is, rotated in both of normal and reverse directions by the feed-out roller driving portion, as well as so that a rotation speed can be controlled by the feed-out roller driving portion, thereby being capable of feeding out the belt-shaped cleaning member 43 wound like a coil or a roll.

The take-up roller 46 is a reel-like member like the feed-out roller 45, and takes up the cleaning member 43 having been fed out from the feed-out roller 45 and having been pressed against the heating roller 12 by the pressure-contact roller 44 to clean up toner. The take-up roller 46 is connected to a take-up roller driving portion (not illustrated), and configured so as to be reversibly rotated, that is, rotated in both of normal and reverse directions by the take-up roller driving portion, as well as so that a rotation speed can be controlled by the take-up roller driving portion.

The first guide roller 47 is disposed so as to abut on the cleaning member 43 between the pressure-contact roller 44 and the take-up roller 46, and the second guide roller 48 is disposed so as to abut on the cleaning member 43 between the feed-out roller 45 and the pressure-contact roller 44. It is preferred that the first and second guide rollers 47 and 48 are rollers made of metal having excellent thermal conductivity such as ferroalloy, aluminum, aluminum alloy, copper or copper alloy. This is because in a case where the first and second guide rollers 47 and 48 are made of metal having excellent thermal conductivity, it is possible, when the cleaning member 43 having cleaned the surface of the heating roller 12 comes in contact with and passes by the guide rollers, to easily solidify the molten or softened toner adhering to the cleaning member 43 by transferring heat to the guide rollers and eliminating the heat.

The first and second guide rollers 47 and 48 are arranged in positions where the guide rollers can further stretch out the cleaning member 43 that is stretched between the pressure-contact roller 44 and the take-up roller 46 and between the pressure-contact roller 44 and the feed-out roller 45. By arranging the first and second guide rollers 47 and 48 so that the cleaning member 43 is further stretched out as described above, tensile force applied to the cleaning member 43 becomes more stable, and vibrations of the cleaning member 43 in take-up operation are suppressed.

Although it is preferred that the first cleaning unit 41 has the first and second guide rollers 47 and 48, a configuration thereof is not limited thereto, and the first cleaning unit may be configured without the first guide roller 47 and the second guide roller 48.

An operation of the first cleaning unit 41 will be briefly described below. After being fed out from the feed-out roller 45 and stretched on the second guide roller 48, the cleaning member 43 is made to pass through the nip portion 49 formed between the pressure-contact roller 44 and the heating roller 12 and stretched on the first guide roller 47, and then a tip portion of the cleaning member 43 is bitten and taken up by the take-up roller 46. When the take-up roller 46 takes up the tip portion of the cleaning member 43, the feed-out roller 45 exerts a brake function, whereby tensile force is applied to the cleaning member 43.

A take-up operation of the take-up roller 46 stops in a state where tensile force is applied to the cleaning member 43, and the heating roller 12 performs a rotating operation in a state where the cleaning member 43 remains stationary, whereby the surface of the heating roller 12 and the cleaning member 43 slidingly contact with each other, and the cleaning member 43 cleans the surface of the heating roller 12. When a certain amount of toner has been cleaned up, the take-up roller 46 executes a take-up operation of taking up the cleaning member 43. That is to say, the take-up roller 46 is driven to intermittently rotate. A take-up direction denoted by arrow 50 of the cleaning member 43 at this moment is an opposite direction to the rotation direction denoted by arrow 28 of the heating roller 12.

A distance in a perimeter direction that the take-up roller 46 rotationally moves, namely, a distance that the cleaning member 43 moves on one occasion for taking up when the take-up roller is driven to intermittently rotate is set to be equal to or more than a distance in a perimeter direction of the nip portion 49 formed by the heating roller 12 and the pressure-contact roller 13 pressed thereagainst. By thus causing the take-up roller 46 to take up the cleaning member 43 by at least the distance in the perimeter direction of the nip portion 49 or more, it is possible to securely send an unused part of the cleaning member 43 to the nip portion 49, so that it is possible to securely restore the cleaning ability of the cleaning member 43 in each take-up operation.

Further, since an oilless member is used as the cleaning member 43 and no oil is supplied to the surface of the heating roller 12 from the cleaning member 43, excessive oil does not exist on the surface of the heating roller 12 and the cleaning member 43 itself is not slippery. Therefore, it is avoided that molten toner on the heating roller 12 forms a mixture with oil, and the molten toner is securely eliminated and cleaned up by the cleaning member 43 without slipping through the nip portion 49 formed by the cleaning member 43 and the heating roller 12 when entering the nip portion 49.

Figure 2:
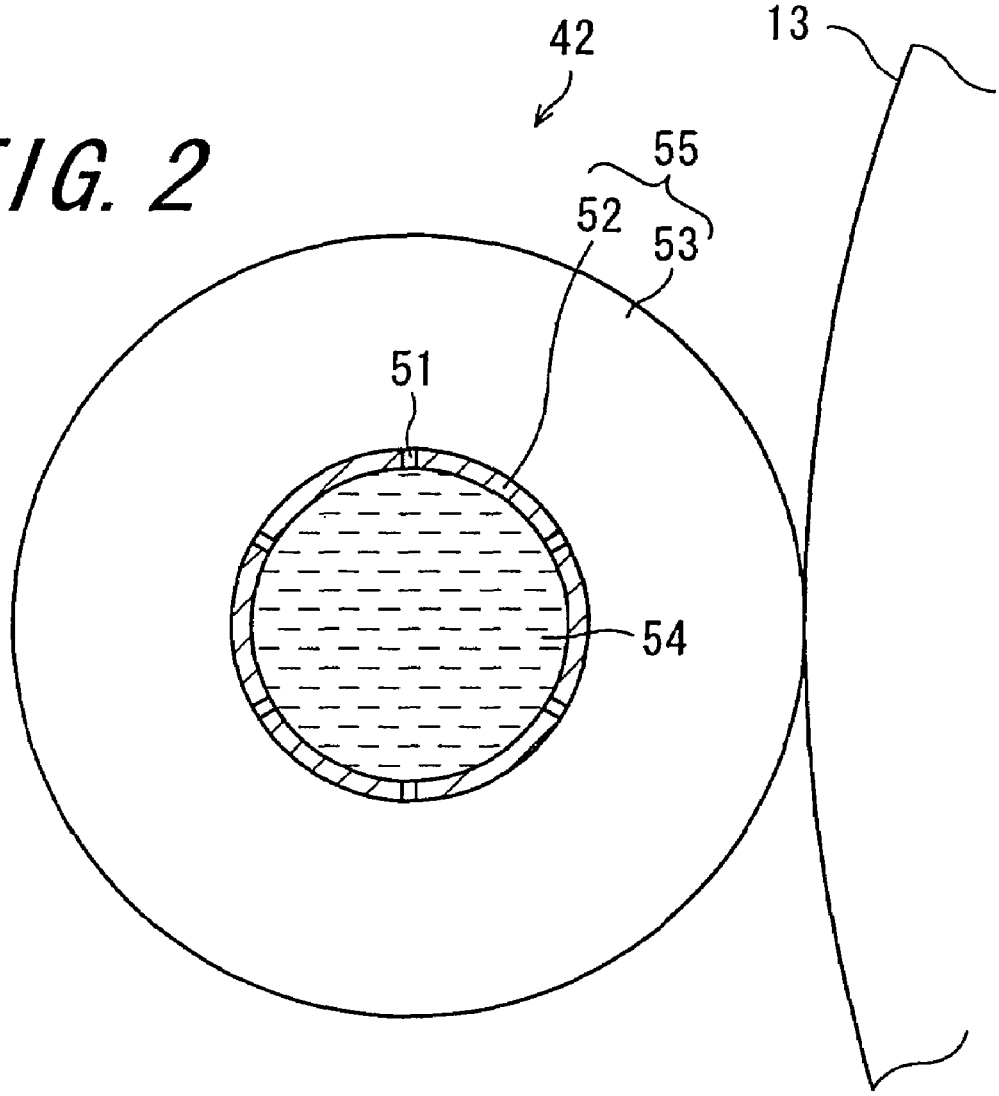
FIG. 2 is a magnified view illustrating an area of a second cleaning unit of the fixing apparatus illustrated in FIG. 1.

FIG. 2 is a magnified view illustrating an area of the second cleaning unit 42 of the fixing apparatus 40 illustrated in FIG. 1. The second cleaning unit 42 is placed on the downstream side of the second paper peeling claw 17 and on the upstream side of the second temperature sensor 15 with respect to the rotation direction of the pressurizing roller 13.

The second cleaning unit 42 has a cylindrical shape, and includes: a core body member 52 provided with a plurality of through holes 51 that pierce a wall of the cylinder; an exterior member 53 made of a fibrous material and disposed in layers on a circumferential face of the core body member 52; and oil 54 for promoting releasability, which is held in a space inside the cylinder of the core body member 52. For convenience, a combination of the core body member 52 holding the oil 54 and the exterior member 53 is referred to as an oil supply roller 55.

The second cleaning unit 42 includes not only the oil supply roller 55 but also a roller pressing portion for pressing the oil supply roller 55 against the pressurizing roller 13, but illustration thereof is omitted. Although the oil supply roller 55 may have a driving portion and rotate by itself, the oil supply roller in the present embodiment is configured so as to be pressed against the pressurizing roller 13 and rotationally driven in accordance with rotation of the pressurizing roller 13.

The core body member 52 is a cylindrical member made of aluminum, aluminum alloy or the like. The core body member 52 is provided with the plurality of through holes 51 having small diameters on the wall of the cylinder. The amount of the oil welled up from the core body member 52 toward the exterior member 53 is adjusted by regulating the diameters of the through holes 51 formed on the cylinder wall of the core body member 52, the number of the through holes, geometrical arrangement of the through holes and so on. It is appropriate to use, for example, silicone oil as the oil 54 that is held in the space inside the core body member 52 and used for promoting releasability of the recording sheet 23 on which a toner image has been fixed from the roller.

As the exterior member 53, it is appropriate to use a fibrous material, for example, felt obtained by fulling wool fiber and forming into a sheet. The oil 54 welled up from the through holes 51 of the core body member 52 penetrates through fibers of the exterior member 53 and reaches an outer surface thereof, and is supplied to the surface of the pressurizing roller 13. Therefore, fiber density of the exterior member 53 is also a factor in regulating the amount of the oil supplied to the pressurizing roller 13.

The exterior member 53 plays a role of a configuration for supplying the oil to the pressurizing roller 13, and also has a function of eliminating the molten toner on the surface of the pressurizing roller 13 and cleaning up the pressurizing roller 13 when being rotationally driven in accordance with rotation of the pressurizing roller 13.

The configuration for supplying the oil to the pressurizing roller 13 is not necessarily the configuration of the second cleaning unit 42, and may be others. For example, the oil supplying means may be configured so as to pump up from an oil tank and supply to the circumferential face of the oil supply roller or supply from the oil tank by utilizing a capillary phenomenon, instead of supplying the oil from inside the core body member.

Figure 3:
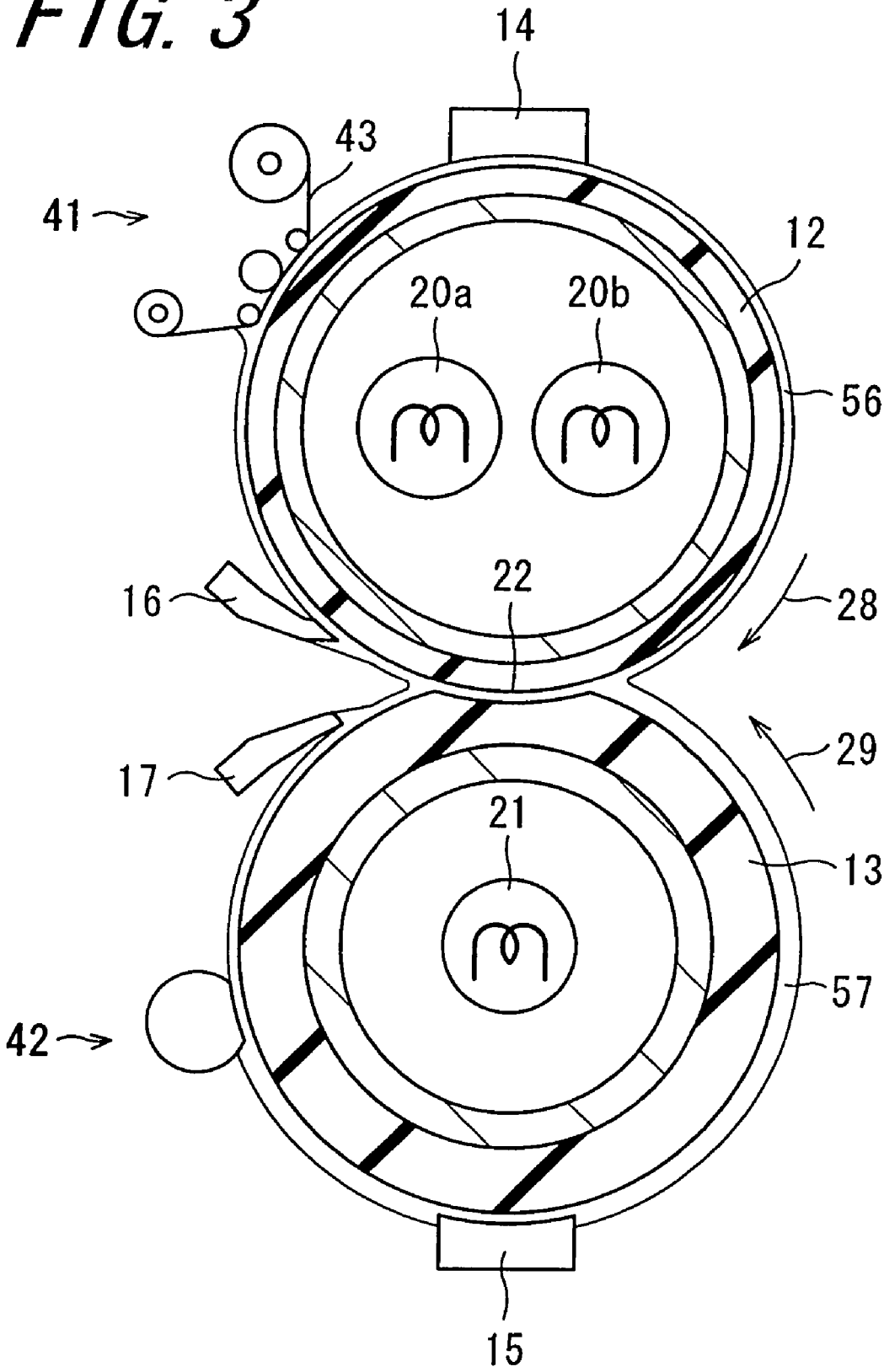
FIG. 3 is a view illustrating a flow of oil applied to a pressurizing roller in a case where a recording sheet is not passed through the fixing apparatus.
Figure 4:
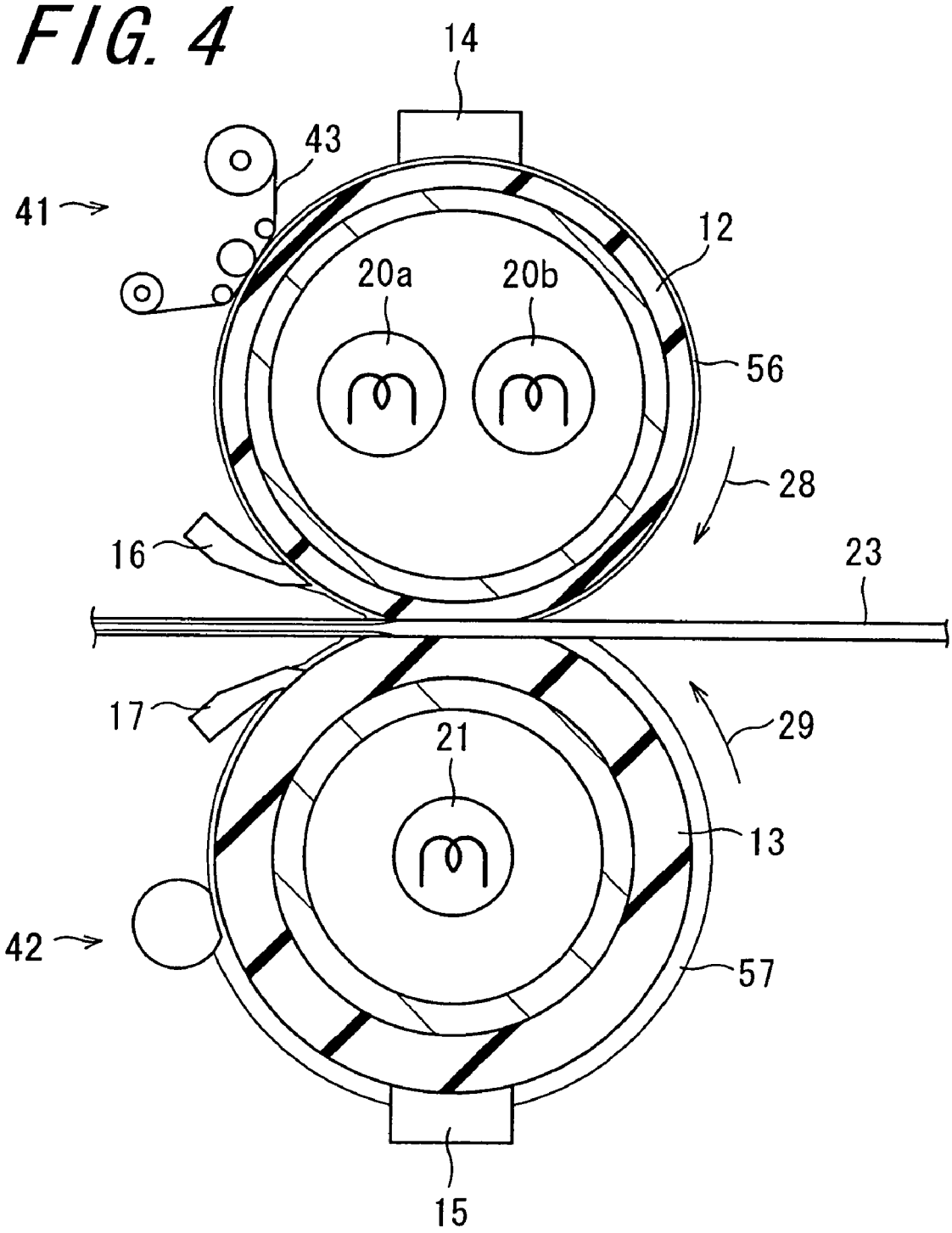
FIG. 4 is a view illustrating a flow of the oil applied to the pressurizing roller in a case where a recording sheet is passed through the fixing apparatus.

FIG. 3 is a view illustrating a flow of the oil applied to the pressurizing roller 13 in a case where a recording sheet is not passed through the fixing apparatus 40, and FIG. 4 is a view illustrating a flow of the oil applied to the pressurizing roller 13 in a case where a recording sheet is passed through the fixing apparatus 40.

In a case where a recording sheet is not passed through the fixing apparatus 40 (referred to as a moment of no sheet passing), the oil supplied to the surface of the pressurizing roller 13 by the second cleaning unit 42 is also supplied to the surface of the heating roller 12 from the surface of the pressurizing roller 13 via the nip portion 22, whereby oil films 56 and 57 are formed on the surfaces of the rollers 12 and 13, respectively. Here, the moment of no sheet passing is a moment of rotation for a warm-up, an interval of sheets during printing in image formation and so on.

In the fixing apparatus 40, the cleaning member 43 of the first cleaning unit 41 is oilless, no oil is supplied from the first cleaning unit 41 to the heating roller 12, and oil is supplied only from the second cleaning unit 42 to the pressurizing roller 13, so that the oil supplied only on the side of the pressurizing roller 13 is shared by the heating roller 12 and the pressurizing roller 13.

Accordingly, unlike a case of supplying the oil to the heating roller and the pressurizing roller from the cleaning unit provided for the heating roller and the pressurizing roller, respectively, the fixing apparatus 40 of the present embodiment can prevent occurrence of excessive oil, that is, prevent occurrence of the excessive oil phenomenon as described before.

Further, in a case where a recording sheet is passed through the fixing apparatus 40 (referred to as a moment of sheet passing), excessive oil is absorbed and taken away from the oil films 56 and 57 by the recording sheet 23 passing through the nip portion 22 and, on the heating roller 12, oil adhering to the molten toner is absorbed and taken away with the molten toner by the oilless cleaning member 43, with the result that an occasion for occurrence of excessive oil is more securely eliminated, and supply of an appropriate amount of oil for maintenance of releasability is realized.

Since formation of a mixture of the excessive oil and the molten toner is also prevented consequently, the molten toner remaining on the fixing rollers is securely eliminated and the fixing rollers are cleaned up without slipping at the first and second cleaning unit 41 and 42 and, in specific, formation of a mixture lump of the oil and the molten toner at the tip portions 16*a* and 17*a* of the first and second paper peeling claws 16 and 17 is avoided, with the result that it is possible to prevent that the recording sheet 23 on which a toner image has been fixed is stained.

Figure 5:
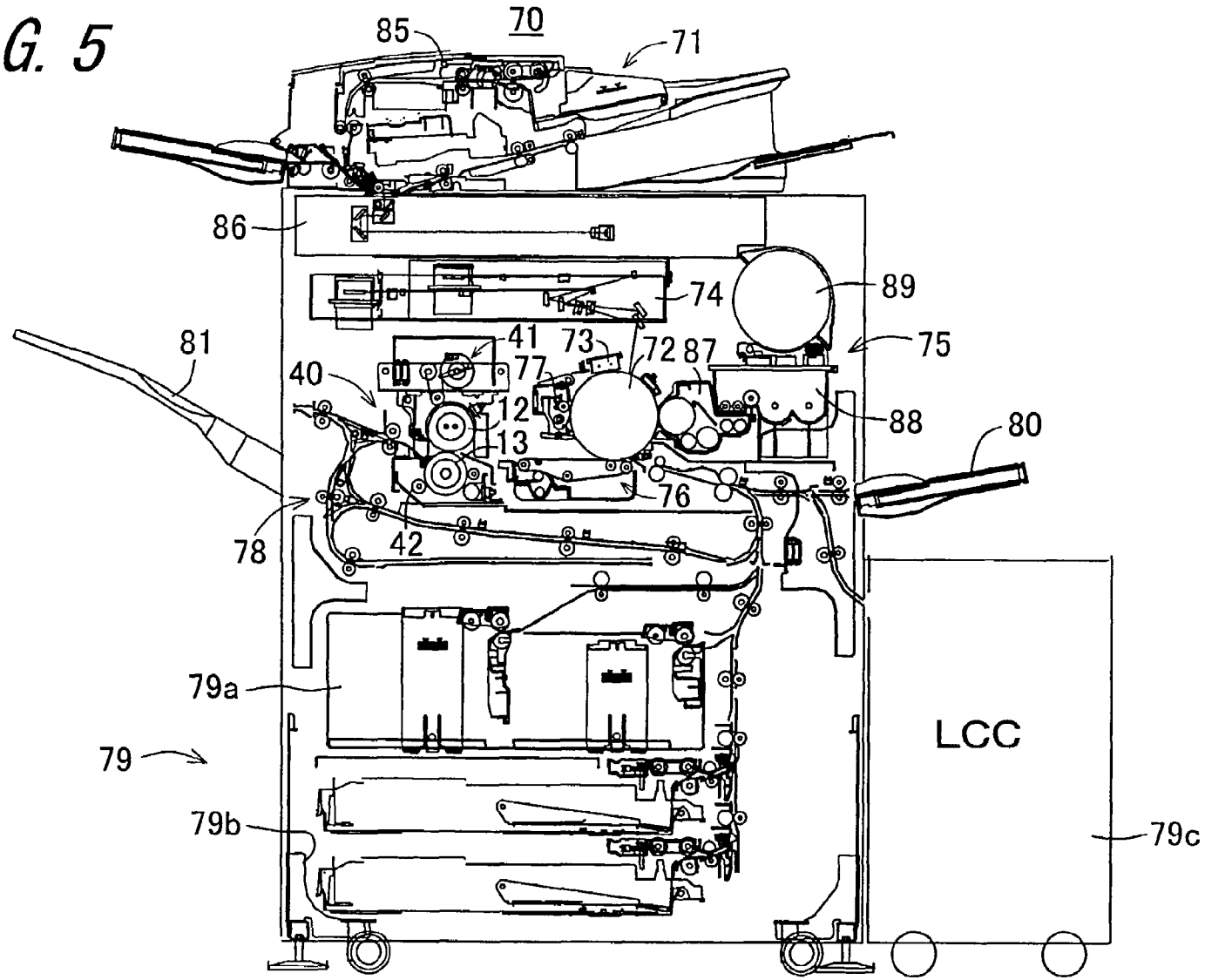
FIG. 5 is a cross-sectional side view illustrating a simplified configuration of an image forming apparatus according to another embodiment of the invention.
Figure 6:
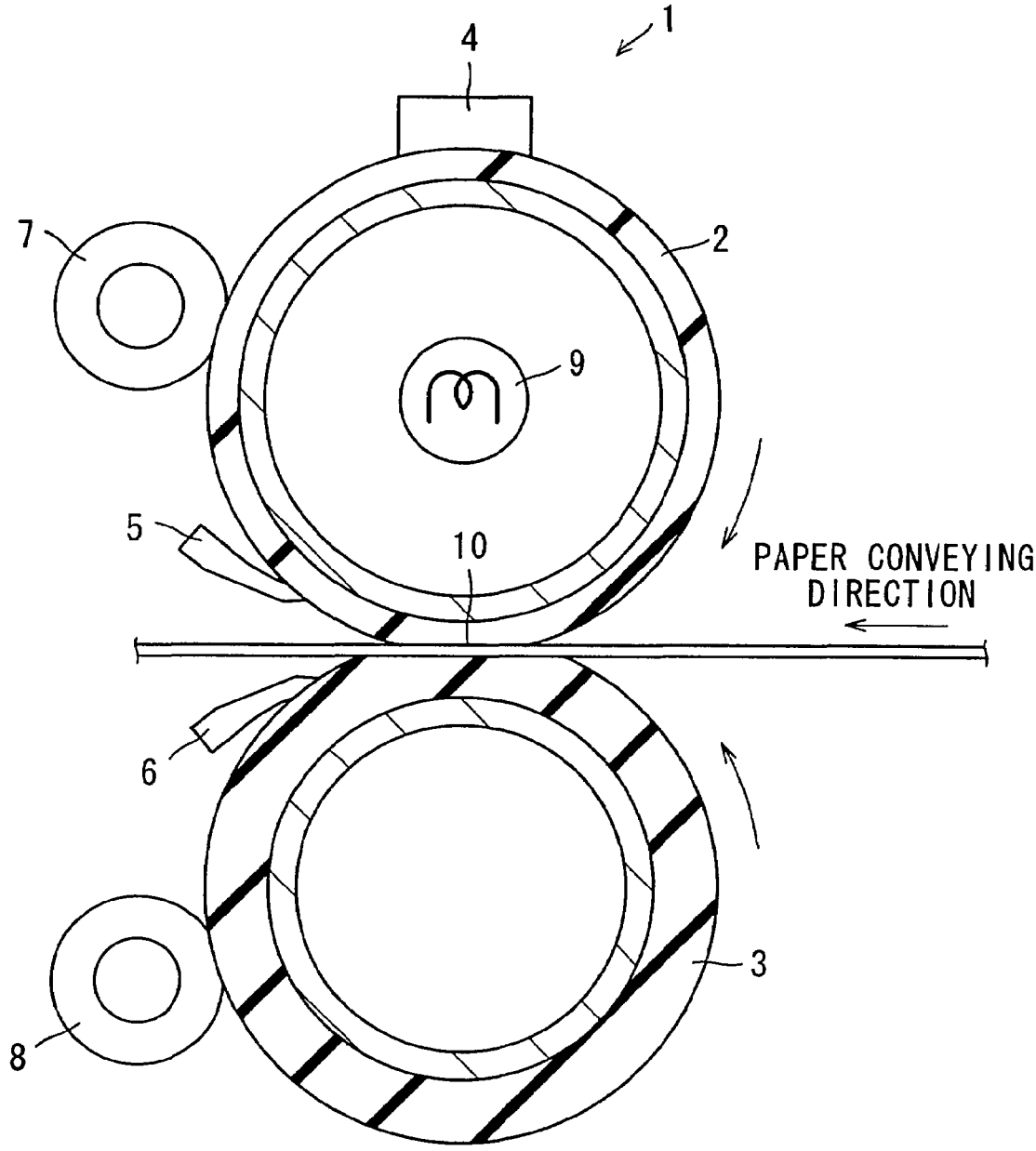
FIG. 6 PRIOR ART
FIG. 6 is a cross section view seen from the side, illustrating a simplified configuration of a conventional fixing apparatus.

FIG. 5 is a cross-sectional side view illustrating a simplified configuration of an image forming apparatus 70 according to another embodiment of the invention. The image forming apparatus 70 illustrated in FIG. 5 is used for forming a monochrome image by electrophotography on a specified sheet (recording sheet) in accordance with image information inputted from an external apparatus such as a personal computer or from an image reading portion 71, and is a so-called high-speed apparatus in which a printing process speed, namely, a process speed is high (for example, 100-120 sheets per minute in terms of A4 landscape size).

In brief, the image forming apparatus 70 comprises: the image reading portion 71; an electrophotographic photoconductor 72; a charging device 73, an exposing unit 74, a developing device 75, a transfer unit 76 and a cleaner unit 77 that are arranged around the electrophotographic photoconductor 72; the fixing apparatus 40 of the invention; a paper conveying path 78; an automatic paper feeding tray 79; a manual-bypass paper feeding tray 80; and a paper ejection tray 81.

The image reading portion 71 is a portion that reads image information of an original at the time of formation of a copy image. The image reading portion is disposed to an upper part of the image forming apparatus 70, and includes an original placing sending portion 85 and an optical scanning portion 86. The image reading portion 71 reads image information of an original placed on the original placing sending portion 85 by causing the optical scanning portion 86 to scan, and the read image information is inputted to an image processing portion (not illustrated).

The charging device 73 is charging means for uniformly charging a surface of the electrophotographic photoconductor 72 to specified potential. As the charging device 73, a charger type of charging device may be used, or a contact type of charging device such as a roller type or a brush type may be used.

As the exposing unit 74, a laser scanning unit (LSU) having a laser irradiating portion and a reflection mirror is used. In order to execute a high-speed printing process, the image forming apparatus 70 employs the two-beam technique so as to be capable of advancing irradiation timing by using a plurality of laser beams. The exposure unit 74 exposes the electrophotographic photoconductor 72 uniformly charged by the charging device 73, in accordance with image information outputted from the image processing portion, thereby forming an electrostatic latent image on the surface of the electrophotographic photoconductor 72. As the exposing unit, the LSU is not necessarily used, and writing head in which light emitting elements such as ELs or LEDs are formed in an array may be used.

The developing device 75 makes the electrostatic latent image formed on the electrophotographic photoconductor 72 visible by black toner of developer. The developing device 75 includes a development tank 87, a toner precharge box 88, and a toner supply box 89. The development tank 87 includes a developing roller for supplying toner to the electrophotographic photoconductor 72, a layer-thickness regulating member for regulating thickness of a toner layer formed on a circumferential face of the developing roller, a stirring supply roller for supplying toner to the developing roller in the development tank 87 and so on.

The toner precharge box 88 is a portion that characterizes the high-speed image forming apparatus of the present embodiment. In an image forming apparatus in which a printing process speed is not so high, toner is directly supplied from the toner supply box to the development tank. However, in a high-speed type of image forming apparatus, the amount of toner consumed per unit time is large when an image forming operation is executed. Therefore, in a case where the image forming apparatus is configured so as to directly supply toner from the toner supply box to the development tank, toner supplied from the toner supply box to the development tank is supplied to the developing roller in an extremely short time period, and time to charge the toner cannot be secured sufficiently, with the result that a failure of image density may occur. Accordingly, the high-speed image forming apparatus 70 of the present embodiment is equipped with the toner precharge box 88 between the toner supply box 89 and the development tank 87, and configured so as to once supply toner from the toner supply box 89 to the toner precharge box 88 to preliminarily charge the toner in the toner precharge box 88, and thereafter supply the toner from the toner precharge box 88 to the development tank 87, thereby being capable of following development in a high-speed printing process without causing a failure in charge of toner.

The toner image developed and made to be visible on the electrophotographic photoconductor 72 is transferred by the transfer unit 76 onto a conveyed recording sheet. The transfer unit 76 includes: driving and driven rollers, a transfer belt, a elastic conductive roller, a discharge roller and a transfer cleaning unit. The transfer belt is bridged on the driving and driven rollers with resistance in a range roughly from $1\times10^{9}$ to $1\times10^{13}$ Ω·cm. An elastic conductive roller is disposed so as to abut on the electrophotographic photoconductor 72 via the transfer belt and is capable of applying a transfer electric field. The discharge roller is disposed on a downstream side in a transfer region of the transfer belt and discharges the electric field applied to the conveyed recording sheet in the transfer region. The transfer cleaning unit eliminates a stain caused by the toner on the transfer belt and charges of the transfer belt. The transfer unit 76 applies an electric field of opposite polarity to polarity of electric charges that the toner image has to the elastic conductive roller while causing the transfer belt to convey a recording sheet on which a toner image has been formed, thereby transferring the toner image from the electrophotographic photoconductor 72 onto the recording sheet. For example, when the toner image has electric charges of (−) negative polarity, the polarity of applied electric field by the transfer unit 76 is (+) positive polarity.

The cleaner unit 77 disposed on a downstream side of the transfer unit 76 with respect to a rotation direction of the electrophotographic photoconductor 72 eliminates and collects toner that has not been transferred from the electrophotographic photoconductor 72 onto the recording sheet in a transfer operation, namely, residual toner, from the surface of the electrophotographic photoconductor 72.

The recording sheet on which the toner image has been transferred by the transfer unit 76 is conveyed to the fixing apparatus 40. The configuration of the fixing apparatus 40 of the invention is as described before referring to FIGS. 1 to 4, and a description thereof will be omitted here. The recording sheet sent into the fixing apparatus 40 is heated and pressurized when passing through the nip portion 22 between the fixing rollers, and unfixed toner is melt by heating and pressed, thereby being fixed on the recording sheet by the anchoring action onto the recording sheet.

The automatic paper feeding tray 79 and the manual-bypass paper feeding tray 80 are trays for accumulating and sending out recording sheets used for image formation and, in the image forming apparatus 70 of the present embodiment, are disposed to a lower part and a side wall face of the apparatus. Since the image forming apparatus 70 aims to execute a high-speed printing process, the apparatus is equipped with three kinds of automatic paper feeding trays 79, that is, first to third automatic paper feeding trays 79*a*, 79*b* and 79*c*. Of the automatic paper feeding trays 79 disposed to the lower part of the apparatus, the first automatic paper feeding tray 79*a* is composed of a pair of cassettes arranged in a row. Each of the cassettes can hold 1500 recording sheets at the maximum in terms of standard size, for example, A4 size, and can supply the recording sheets so as to follow a high-speed printing process executed on the recording sheets of standard size. Moreover, a paper feed for image formation is controlled so that it is possible to alternately feed paper from the two cassettes, whereby a time loss at the time of feeding of a recording sheet resulting from time required for an operation of a pickup roller that feeds out the recording sheets one by one from the cassette is covered. The second automatic paper feeding tray 79*b* disposed below the first automatic paper feeding tray 79*a* includes two cassettes arranged from top to bottom, which are universal cassettes holding and supplying recording sheets of nonstandard size.

The third automatic paper feeding tray 79*c* is disposed in contact with the side wall face of the apparatus. The third automatic paper feeding tray 79*c* is a large-capacity paper feeding tray, and is capable of holding a large amount of, for example, about 8000 recording sheets of one of a plurality of sizes. Moreover, on the side wall face of the apparatus, above the third automatic paper feeding tray 79*c*, the manual-bypass tray 80 that chiefly holds and supplies recording sheets used for free size printing or the like.

The paper ejection tray 81 is placed on a side face of the apparatus on the opposite side to the manual-bypass tray 80. The image forming apparatus may be equipped with, instead of the paper ejection tray 81, a device for subjecting an ejected recording sheet to a finishing process (a stapling process, a punching process and so on), a multiple-stage paper ejection tray or the like. The paper conveying path 78 is a conveying path for sending and feeding recording sheets for image formation from the respective paper feeding trays, and also a conveying path for conveying recording sheets on which images have been formed and fixed to the paper ejection tray 81. In the image forming apparatus 70 of the present embodiment, the paper conveying path 78 is configured so as to be changeable in order that an ejection mode of an ejected recording sheet can be selected from between face-up and face-down in accordance with printing process conditions such as simplex/duplex printing or the number of sheets subjected to a batch printing process, though a detailed description will be omitted.

The image forming operation in the image forming apparatus 70 will be briefly described. First, image information of an original read by the image reading portion 71 is inputted to the image processing portion (not illustrated) and subjected to image processing such as tone processing, and the image information is stored into a memory. The surface of the electrophotographic photoconductor 72 is charged by the charging device 73 to almost uniform potential, and is irradiated by the exposing unit 74 with light according to the image information read out of the memory, whereby an electrostatic latent image is formed.

Toner of developer is supplied from the developing device 75 to the electrostatic latent image formed on the surface of the electrophotographic photoconductor 72, whereby a toner image is formed. The toner image formed on the surface of the electrophotographic photoconductor 72 is transferred by the transfer unit 76 to a recording sheet conveyed from, for example, the automatic paper feeding tray 79 in synchronism with image formation, and then fixed by the fixing apparatus 40, and the recording sheet is ejected to the paper ejection tray 81.

On the other hand, from the surface of the electrophotographic photoconductor 72 after the toner image is transferred therefrom, residual toner and so on are eliminated by the cleaner unit 77 and electric charges are eliminated by the discharging device, and the electrophotographic photoconductor gets ready for next image formation. The series of operations are executed repeatedly, whereby images are formed.

According to the image forming apparatus 70, the fixing apparatus 40 is provided, and hence excessive oil is not supplied to the fixing rollers of the fixing apparatus 40. Therefore, it is avoided that a mixture of molten toner and oil is formed on the fixing rollers, and the molten toner is securely eliminated and the fixing rollers are cleaned up without slipping through the nip portions between the first and the second cleaning unit 41, 42 and the fixing rollers. Consequently, a mixture of molten toner and oil that causes a stain on a recording sheet does not accumulate on the tip portion of the paper peeling claw, with the result that it is possible to stably form images of high quality without stains for many hours.

EXAMPLE

An example of the invention will be described below.

In the present example, an experiment was made in the following manner. A converted machine of a printer AR-450 (produced by Sharp Corporation) was prepared as an image forming apparatus, image formation was executed in the apparatus equipped with the fixing apparatus 40 of the invention and in the apparatus equipped with a fixing apparatus that did not have the second cleaning unit, and conditions of stains on recording sheets were evaluated. With the fixing apparatus that did not have the second cleaning unit, image formation was executed in a state where the oil was supplied from the first cleaning unit and in a state where the oil was not supplied from the first cleaning unit.

Set conditions of the first cleaning unit in a case where the apparatus was equipped with the fixing apparatus 40 of the invention and in a case where the apparatus was equipped with the fixing apparatus that did not have the second cleaning unit are illustrated in Table 1. In a case where the oil was impregnated into a web sheet serving as the cleaning member and the oil was supplied to the heating roller, the amount of the oil supplied to one recording sheet was regulated so as to become 0.05-0.1 mg. The amount of the oil supplied to one recording sheet by the first cleaning unit was regulated based on the amount of the oil impregnated into the web sheet and a pressing load of the web sheet against the heating roller by the pressure-contact roller.

Set conditions of the second cleaning unit in a case where the apparatus was equipped with the fixing apparatus 40 of the invention are as follows: Gore-Tex (product name) was used as the exterior member 53 of the oil supply roller 55, and the amount of the oil supplied to one recording sheet was regulated so as to become 0.01-0.02 mg. As described before, the amount of the oil supplied to one recording sheet by the second cleaning unit 42 was regulated based on the number of the through holes 51 formed on the core body member 52, the diameters of the through holes, fiber density of the exterior member 53 and so on.

TABLE 1

| | |
|---|---|
| Material of cleaning member | Aramid + polyester sheet, paper |
| Amount of oil impregnated into cleaning member | Oilless, 15 g/m$^2$, 25 g/m$^2$ |
| Pressing load by pressure-contact roller | 1.25 kg, 1.5 kg, 2 kg |

Image formation was executed in the following manner. First, halftone images were formed on 1000 recording sheets of A4 size prescribed by JIS-P0138, and then, the image forming apparatus was left for three minutes. After the image forming apparatus was left for three minutes, images were formed on five recording sheets in the mode of single sheet passing in which the electrophotographic photoconductor rotated backward and forward while a recording sheet was passed through. Of the five sheets on which images were formed, a first recording sheet that was most easily stained was visually observed, and the condition of the stain was evaluated. An evaluation basis was as follows:

A: no stain

B: a stain, not noticeable in a recorded image of a standard original

C: a noticeable stain, raising a problem for image quality

A result of the visual observation of the conditions of stains is illustrated in Table 2, together with the set conditions. As a result of the visual observation of the stains on the recording sheets, most of the stains were made at the tip portion of the paper peeling claw. Therefore, in the evaluation, a stain made around the first paper peeling claw disposed to the heating roller is expressed as a stain around the "upper claw" for convenience, and a stain made around the second paper peeling claw disposed to the pressurizing roller is expressed as a stain around the "lower claw" for convenience.

Further, to both the "upper claw" and the "lower claw," F (front) is added in the evaluation of a stain made by the paper peeling claw placed on the operation side of the image forming apparatus, and R (rear) is added in the evaluation of a stain made by the paper peeling claw placed on the inner side, which is the opposite side to the operation side. The fixing apparatus of the present example is provided with four upper claws and four lower claws on the F side and four upper claws and four lower claws on the R side, that is, eight upper claws and eight lower claws in total. Therefore, in the evaluation of the stains on the F side and the R side, the result of the visual observation may be divided and expressed in a plurality of levels.

Further, in expression of a material of the cleaning member in Table 2, (aramid+polyester sheet) is abbreviated to N, and paper is abbreviated to P.

In experiments Nos. 6 and 8 adopting the configuration of the fixing apparatus 40 of the invention in which the oilless web sheet that was not impregnated with the oil was used on the heating roller side and the oil supply roller was used on the pressurizing roller side, it was prevented that stains were made on both the sides of the heating roller and the pressurizing roller, and fixed images of good image quality were obtained.

In experiments Nos. 5 and 7 in which the oilless web sheet that was not impregnated with the oil was used on the heating roller side and the oil supply roller was not used on the pressurizing roller side, noticeable stains were made by the lower claws on the pressurizing roller side.

In experiments Nos. 1 to 4 in which the web sheet that was impregnated with the oil was used on the heating roller side and the oil supply roller was not used on the pressurizing roller side, it was prevented that stains were made on the pressurizing roller side, but noticeable stains were made on the heating roller side.

From the experiments Nos. 1 to 3 in which the web sheet that was impregnated with the oil was used on the heating roller side and the oil supply roller was not used on the pressurizing roller side, it is apparent that increase of the pressing load by the pressure-contact roller reduces stains a little but cannot prevent stains.

As apparent from a comparison between the experiments Nos. 6 and 8, a particularly significant difference was not recognized in material of the web sheet between (aramid+polyester sheet) and paper.

TABLE 2

| Experiment Nos. | Pressing load by pressure-contact roller | Material of web sheet & existence of oil | Oil supply roller | Evaluation of stains: Upper claw F | Upper claw R | Lower claw F | Lower claw R |
|---|---|---|---|---|---|---|---|
| 1 | 1.25 | N oil (15 g/m$^2$) | Absent | C | C | A | A |
| 2 | 1.50 | N oil (15 g/m$^2$) | Absent | BC | C | A | A |
| 3 | 2.00 | N oil (15 g/m$^2$) | Absent | BC | BC | A | A |
| 4 | 1.25 | N oil (25 g/m$^2$) | Absent | C | C | A | A |
| 5 | 1.25 | P oilless | Absent | A | A | C | C |
| 6 | 1.25 | P oilless | Present | A | A | A | A |
| 7 | 1.25 | N oilless | Absent | BC | A | C | C |
| 8 | 1.25 | N oilless | Present | A | AB | A | A |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing apparatus comprising:

a heating roller and pressurizing roller that form a couple of rotation bodies, the heating roller and pressurizing roller melt and fix unfixed developer on a recording medium on which an image of the unfixed image is formed by passing the recording medium through a pressure-contact area formed by the heating roller and pressurizing roller;

a first cleaning unit disposed so as to abut on a surface of the heating roller, for cleaning up developer adhering to the surface of the heating roller; and a second cleaning unit disposed so as to abut on a surface of the pressurizing roller, for cleaning up developer adhering to the surface of the pressurizing roller and also supplying oil for promoting releasability of the surface of the pressurizing roller, wherein the first cleaning unit has a belt-shaped cleaning member disposed so as to abut on the surface of the heating roller, for cleaning the surface of the heating roller;

a pressure-contact roller disposed so as to press the cleaning member against the heating roller on which the cleaning member abuts;

a feed-out roller for feeding out the cleaning member; and a take-up roller for taking up the cleaning member having been fed out from the feed-out roller and having cleaned the surface of the heating roller.

2. The fixing apparatus of claim 1, wherein the belt-shaped cleaning member of the first cleaning unit is an oilless member that is not impregnated with the oil.

3. The fixing apparatus of claim 1, wherein the second cleaning unit includes:

a core body member that has a cylindrical shape and is provided with a plurality of through holes piercing a wall of the cylinder;

an exterior member made of a fibrous material and disposed in layers on a circumferential face of the core body member; and the oil for promoting releasability, which is held in a space within the cylinder of the core body member.

4. The fixing apparatus of claim 1, further comprising:

a first paper peeling claw for peeling a recording medium having passed through the pressure-contact area of the heating roller and the pressurizing roller from the heating roller; and a temperature sensor for detecting a temperature of the heating roller, wherein the first cleaning unit is placed between the first paper peeling claw and the temperature sensor with respect to a rotation direction of the heating roller.

5. The fixing apparatus of claim 1, further comprising a second paper peeling claw for peeling a recording medium having passed through the pressure-contact area of the heating roller and the pressurizing roller from the pressurizing roller, wherein the second cleaning unit is placed on a downstream side of the second paper peeling claw with respect to a rotation direction of the pressurizing roller.

6. An image forming apparatus for forming a printed image by electrophotography, comprising the fixing apparatus of claim 1.

* * * * *